US005885051A

United States Patent [19]

Azuma et al.

[11] Patent Number: 5,885,051

[45] Date of Patent: Mar. 23, 1999

[54] WORKPIECE TRANSFER EQUIPMENT IN DICING MACHINE

[75] Inventors: Masayuki Azuma; Hirofumi Shimoda, both of Mitaka, Japan

[73] Assignee: Tokyo Seimitsu Co., Ltd., Tokyo, Japan

[21] Appl. No.: 908,940

[22] Filed: Aug. 8, 1997

[30] Foreign Application Priority Data

Aug. 13, 1996 [JP] Japan ..... 8-213858

[51] Int. Cl.[6] ..... B28D 5/00

[52] U.S. Cl. ..... 414/744.4; 414/941; 83/153; 901/8

[58] Field of Search ..... 414/744.4, 749, 414/935, 941; 901/8; 134/78, 82; 83/151, 153

[56] References Cited

U.S. PATENT DOCUMENTS 4,009,785 3/1977 Drayes ..... 414/941

4,808,059 2/1989 Eddy ..... 414/744.4

FOREIGN PATENT DOCUMENTS 60-214911 10/1985 Japan .

63-288642 11/1988 Japan .

62-156909 1/1989 Japan ..... 414/744.4

*Primary Examiner*—David A. Bucci

*Assistant Examiner*—Gregory A. Morse

*Attorney, Agent, or Firm*—Sixbey, Friedman, Leedom & Ferguson; David S. Safran

[57] ABSTRACT

A wafer is gripped by a chuck part provided at a front end of a slide arm, and the slide arm is moved in the first direction from a reference position, from which the workpiece is transferred to a workpiece cutting part, to a cleansing position, where the cut workpiece is cleansed, so that the wafer can be transferred in the first direction. The wafer is gripped by a chuck part provided at a front end of a rotary arm, which is rotatably supported at a base end by the front end of the slide arm. Then, the slide arm is moved in the first direction and the rotary arm is rotated. Thereby, the wafer can be transferred in the second direction, which is perpendicular to the first direction.

5 Claims, 5 Drawing Sheets

WORKPIECE TRANSFER EQUIPMENT IN DICING MACHINE

BACKGROUND OF THE INVENTION

1. Field of the Invention

The present invention relates generally to workpiece transfer equipment in a dicing machine, and more particularly to workpiece transfer equipment in a dicing machine which efficiently transfers a workpiece to a workpiece cutting part, a workpiece cleansing part, etc.

2. Description of Related Art

Japanese Patent Provisional Publication No. 60-214911 has disclosed a dicing machine. This dicing machine has a reference position where a wafer which is supplied from the cartridge storing a number of wafers is pre-aligned, a second position where the wafer is loaded and unloaded on and from the cutting table, a third position where the cut wafer is cleansed, and a fourth position where the cleansed wafer is unloaded. The wafer which has been loaded on the cutting table at the second position moves with the cutting table and is finely aligned, and then the wafer is cut into desired semiconductor chips with a diamond cutter, etc. Then, the cut wafer is transferred to the third position, where the wafer is cleansed.

The above-mentioned first, second, third and fourth positions are arranged at apexes of a regular square, respectively. The wafers are transferred at the same time by a cross-shaped rotary arm (a cross arm) which has the rotational axis at the center of the regular square, and extends to the four apexes of the regular square. That is, a wafer chuck for gripping a wafer is provided at each end of the cross arm, and the cross arm is rotated by 90° to simultaneously transfer the wafers from the first, second and third positions to the second, third and fourth positions, respectively.

Japanese Patent Provisional Publication No. 63-288642 has disclosed a V-shaped rotary arm (a V-shaped arm) which is an improvement of the cross arm disclosed by the Japanese Patent Provisional Publication No. 60-214911. The V-shaped arm is composed of rotary arms which are extended to two adjacent apexes of a regular square. According to the V-shaped arm, there are two wafer chucks of the rotary arm. If there is the wafer chuck at one of the position where maintenance is performed, the wafer chuck can easily retreat by rotating the rotary arm so that a maintenance space can be secured. The V-shaped arm rotates by a predetermined angle to simultaneously transfer the wafers from the first and second positions to the second and third positions, respectively. The wafer which has been cleansed at the third position is transferred at an appropriate time during the cutting of a following wafer. Thus, the wafer does not have to wait at the wafer cutting part where the wafer is transferred from and to the second position. For this reason, the transfer efficiency is substantially the same as that of the cross arm, and one wafer can be machined within the same period of time.

Each of the above-described cross arm and V-shaped arm transfers the wafers to describe a circular arc around the rotational axis, which is located at the center of the first, second, third and fourth positions. For this reason, a broad space is required compared to the case when the wafer is moved straight to the next position. Since the rotational axis is provided at the center of the first, second, third and fourth positions, the maintenance is difficult and the space cannot be saved.

Moreover, since sludge adheres to the wafer which has been cut by the wafer cutting part and has been unloaded at the second position, the sludge also adheres to the wafer chuck of the rotary arm which transfers the wafer from the second position to the third position. For this reason, the rotary arm to which the sludge adheres is used only for transferring the wafer from the second position to the third position, thereby preventing the spread of the sludge. The rotary arm to which the sludge adheres, however, passes over the first, second, third and fourth positions during rotation, and may strew the sludge over these positions.

SUMMARY OF THE INVENTION

The present invention has been developed in view of the above-described circumstances, and has as its object the provision of wafer transfer equipment in a dicing machine which efficiently transfers the wafer without spreading the sludge and saves the space.

To achieve the above-mentioned object, in the present invention, workpiece transfer equipment in a dicing machine having a work piece cutting part for cutting a workpiece, a reference position from which the workpiece is transferred to the workpiece cutting part, a cleansing position where the cut workpiece is cleansed, which cleansing position is arranged at a predetermined distance in a first direction from the reference position, and one or two stage positions, which are arranged at a predetermined distance from the reference position and/or the cleansing position in a second direction perpendicular to the first direction, and which workpiece transfer equipment transfers the workpiece between the positions, is characterized by comprising: a first arm part for transferring the workpiece from the reference position to the cleansing position with a first chuck part provided at a front end of the first arm part, the first arm part being movable in the first direction, the first chuck part gripping and releasing the workpiece; a second arm part for transferring the workpiece with a second chuck part provided at a front end of the second arm part, the second arm part being rotatably supported at a base end by the front end of the first arm part, the second chuck part being at a distance equal to the distance between the reference position and the stage position from the first chuck part, the second chuck part gripping and releasing the workpiece; a first arm driving means for moving the first arm part in the first direction; a second arm driving means for rotating the second arm part; a controlling means for controlling the first and second arm driving means and controlling the first and second chuck parts to grip and release the workpiece; and in the workpiece transfer equipment, the controlling means moves the first arm part in the first direction so as to transfer the workpiece in the first direction, and moves the first arm part in the first direction and rotates the second arm part at the same time so as to transfer the workpiece in the second direction.

According to the present invention, the first and second arms are provided. The first arm part is movably in the first direction, and the first chuck part for gripping and releasing the workpiece is provided at the front end of the first arm part. The second arm part is rotatably supported at the base end by the front end of the first arm part, and the second chuck part is provided at the front end of the second arm part, which second chuck part is at the distance equal to the distance between the reference position and the cleansing position from the first chuck part. The first arm part is moved in the first direction by the first arm driving means, and the second arm part is rotated by the second arm driving means.

The controlling means moves the first arm part in the first direction so as to transfer the workpiece in the first direction. To transfer the workpiece in the second direction, the controlling means moves the first arm part in the first direction and rotates the second arm part.

The first arm part is moved in the first direction from the reference position, from which the workpiece is transferred to the workpiece cutting part, to the cleansing position, where the cut workpiece is cleansed, so that the workpiece can be transferred in the first direction. The first arm part is moved in the first direction and the second arm part is rotated, so that the workpiece can be transferred in the second direction perpendicular to the first direction. That is, the first chuck part, which is provided at the front end of the first arm part, moves only between the reference position and the cleansing position, and hence, the sludge adhering to the first chuck part resulting from the gripping the cut workpiece is not spread to other positions. Compared to the conventional rotary arm, there is no need to provide the transfer arm at the center of the workpiece transfer positions, and the workpiece can be transferred straight to another adjacent position, so that the space can be saved. Further, compared to the rotary arm, the combination of the first and second arms can enlarge the accessible area.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
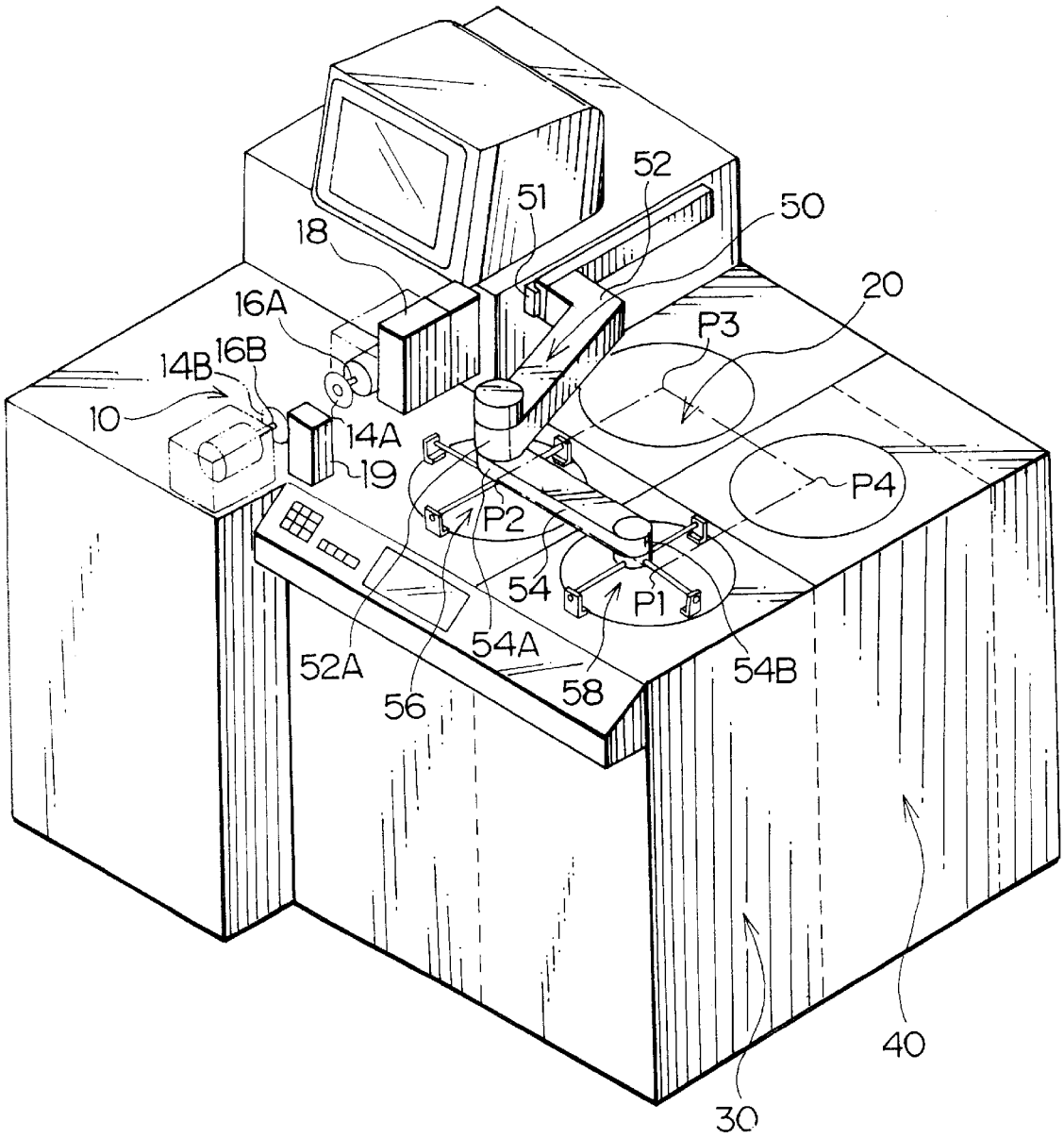
FIG. 1 is a perspective view of a dicing machine with workpiece transfer equipment according to the present invention.
Figure 2:
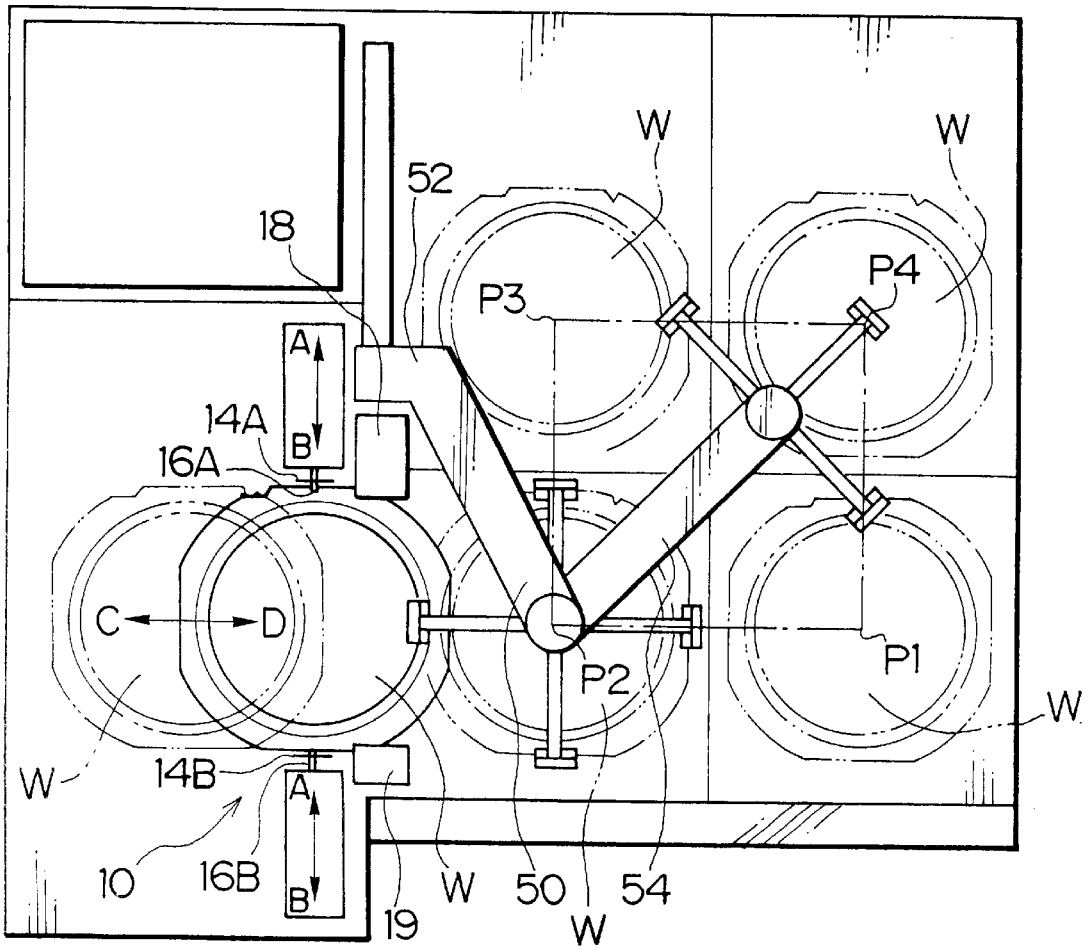
FIG. 2 is a plan view of the dicing machine with the workpiece transfer equipment according to the present invention.

FIG. 1 is a perspective view of a dicing machine with workpiece transfer equipment according to the present invention, and FIG. 2 is a plan view thereof. The dicing machine is comprised mainly of a cutting part 10 for cutting a workpiece (a wafer) W in directions perpendicular to one another to thereby cut the wafer W in a grid pattern; a cleansing part 20 for cleansing the cut wafer; a cassette part 30 for storing wafers before and after processing; an elevator part 40 for pulling out the wafer W before processing from a desired position in the cassette part 30 to prealign the wafer on a stage and for replacing the processed wafer, which is set on the stage, at a desired position in the cassette part 30; and a transfer unit 50 for transferring the wafer W through the above-mentioned processing steps.

The transfer unit 50 transfers the wafer W through four positions P1, P2, P3, P4, which are at apexes of a regular square shown in FIG. 2 with alternate long and short dash lines. At P1, the wafer W is preloaded; at P2, the wafer W is loaded on and unloaded from a cutting table, which transfers the wafer W to the cutting part 10; at P3, the wafer W is loaded on and unloaded from a spin table of the cleansing part 20; and at P4, the wafer W before processing is loaded and the processed wafer W (after cleansing) is unloaded.

The cutting part 10 is comprised mainly of two spindles 16A, 16B provided with blades 14A, 14B; and fine alignment parts 18, 19 for finely aligning the wafer W by recognizing a pattern on the wafer W with its image. The spindles 16A, 16B and the fine alignment parts 18, 19 are movable in directions indicated by arrows A and B in FIG. 2, and the cutting table, on which the wafer W is placed, is rotatable and movable in directions of arrows C and D. The fine alignment parts 18, 19 finely align the wafer W on the cutting table by rotating the cutting table in accordance with the recognized pattern on the wafer W, and moving the spindles 16A, 16B of the cutting part 10 and the fine alignment part 18 in the directions of the arrows A and B.

With the movement of the cutting table, the aligned wafer W is cut with the blades 14A, 14B rotating with the spindles 16A, 16B. The cutting is sequentially performed so that the wafer W can be cut in a grid pattern.

The cleansing part 20 cleanses the cut wafer W. The cleansing part 20 lowers and spins the spin table on which the wafer W is placed, and cleanses the wafer W with pure water. Then, the cleansing part 20 blows the cleansed wafer W dry, and raises the spin table.

Figure 3:
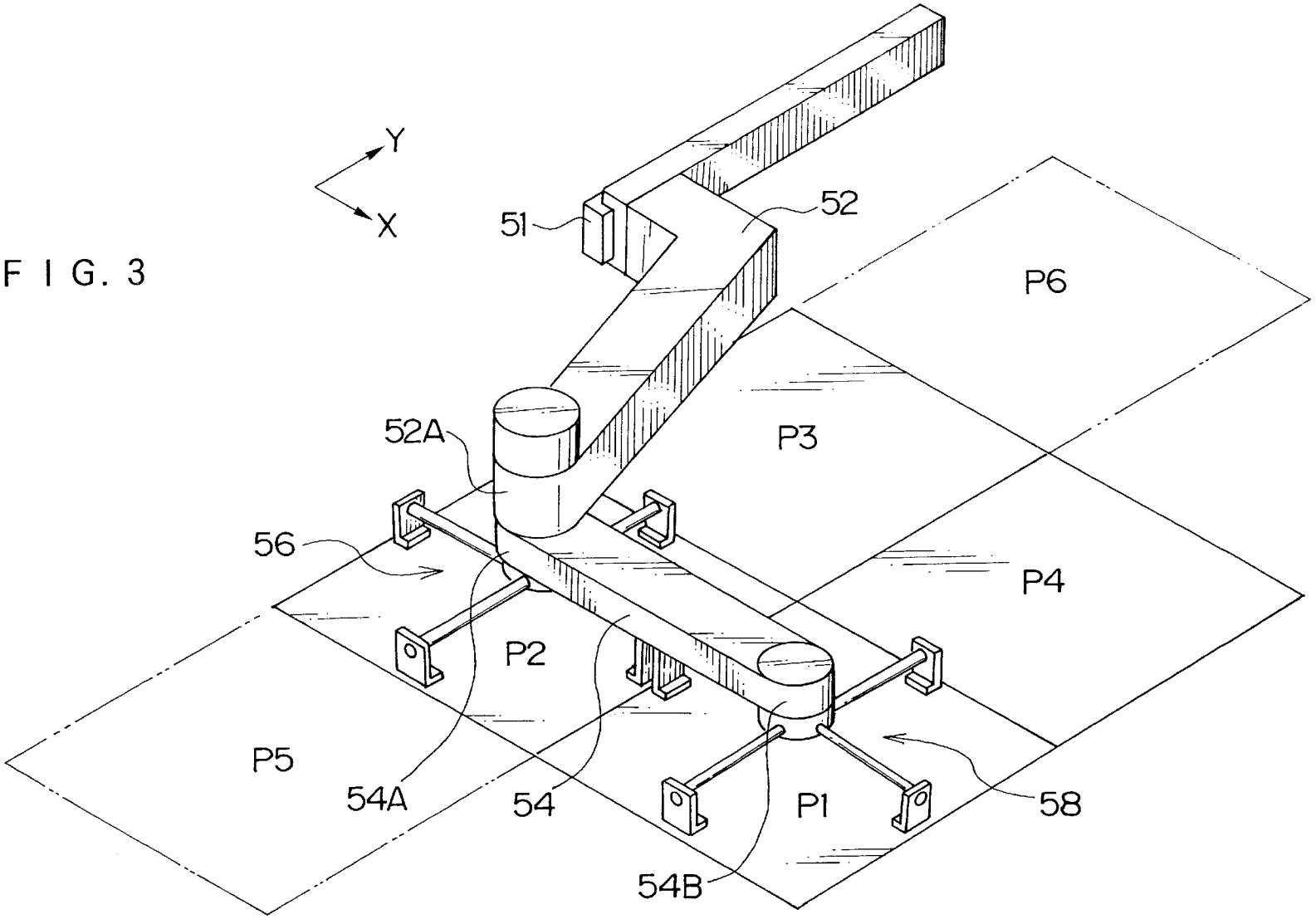
FIG. 3 is a perspective view of the dicing machine with the workpiece transfer equipment according to the present invention.

As shown in FIG. 3, the transfer unit 50 consists of a slide arm 52 movably attached to a rail 51, which is provided in the direction of the Y-axis; a rotary arm 54, which is rotatably attached to a front end 52A of the slide arm 52; and two chuck parts 56, 58 attached to ends 54A, 54B of the rotary arm 54.

The slide arm 52 is moved back and forth along the rail 51 by a motor (not shown), and the front end 52A (the base end 54A of the rotary arm 54) shifts between two positions P2 and P3. The rotary arm 54 is rotated around the base end 54A by a motor, and the front end 54B of the rotary arm 54 shifts the positions P1, P2, P3 and P4 according to the rotation of the rotary arm 54 and the sift of the slide arm 52.

For example, when the front end 52A of the slide arm 52 (the base end 54A of the rotary arm 54) is located at the position P2, the front end 54B of the rotary arm 54 rotates between the positions P1 and P3. When the end 52A of the slide arm 52 is located at the position P3, the front end 54B of the rotary arm 54 rotates between the positions P2 and P4.

The chuck parts 56, 58 are rotatably provided at the ends 54A, 54B of the rotary arm 54, and they grip the wafer W with four pawls, which move horizontally and vertically.

The transfer unit 50 is capable of transferring the wafer W to positions P5, P6 shown in FIG. 3 in addition to the above-mentioned positions P1–P4. Thus, the transfer unit 50 is able to transfer the wafer via six processing steps, whereas a conventional rotary arm transfers the wafer via only four processing steps. Moreover, since the wafer can be transferred over a wide area, there is no need to arrange the processing positions at apexes of the regular square, and the efficiency can be improved.

Next, an explanation will be given about the procedure for transferring wafers by the transfer unit 50.

Figure 4A:
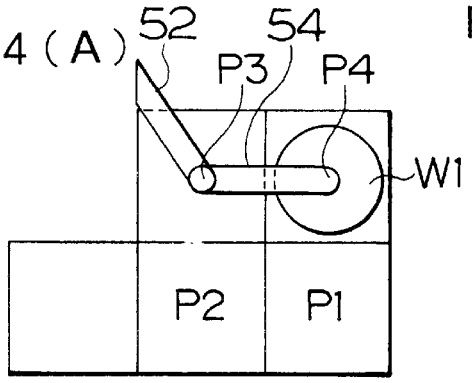
FIGS. 4(A), 4(B), 4(C), 4(D), 4(E), 4(F), 4(G), 4(H), 4(I), 4(J) and 4(K) are views describing a procedure of transferring workpieces by the workpiece transfer equipment in the dicing machine according to the present invention.

FIGS. 4(A), 4(B), 4(C), 4(D), 4(E), 4(F), 4(G), 4(H), 4(I), 4(J) and 4(K) are plan views of the dicing machine in each step of transferring the wafer(s). In an initial state, a wafer W1 is removed from the cassette part 30 toward the elevator part 40 and set at the position P4, and the chuck parts 56, 58 of the rotary arm 54 are located at P3 and P4, respectively, as shown in FIG. 4(A).

Figure 4D:
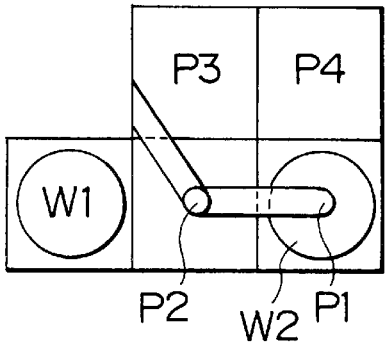
Figure 4B:
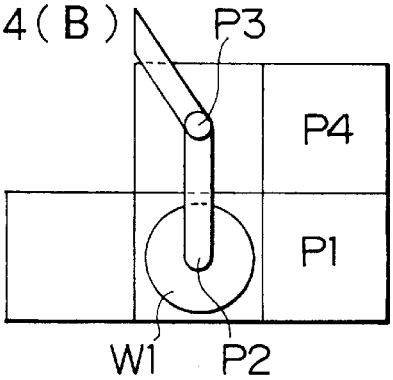

In order to transfer the wafer W1 from the position P4, the chuck part 58 grips the wafer W1, and then the rotary arm 54 is rotated by 90° clockwise. Thereby, the wafer W1 moves from P4 to P2 as shown in FIG. 4(B), and the wafer W1 is placed on the cutting table at P2. Thereafter, the wafer W1 moves to the cutting part 10 along with the cutting table, and the wafer W1 is finely aligned and cut.

On the other hand, after the wafer W1 is released from the chuck part 58, the rotary arm 54 rotates by 90° counterclockwise to return to the position P4 during the cutting of the wafer W1. Then, a next wafer W2 is transferred by the elevator part 40 to the position P4 as shown in FIG. 4(C). In this state, the chuck part 58 grips the wafer W2, and the slide arm 52 moves forward. Thereby, as shown in FIG. 4(D), the wafer W2 moves from P4 to P1 where it is placed on the preload stage.

Figure 4E:
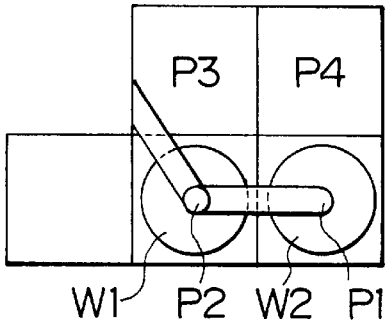
Figure 4C:
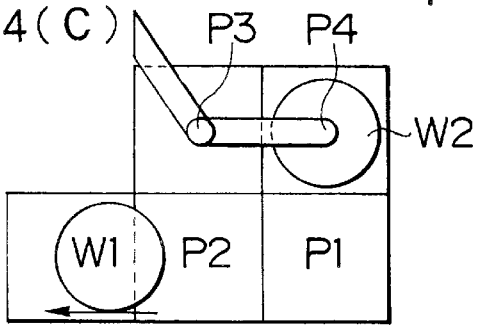
Figure 4F:
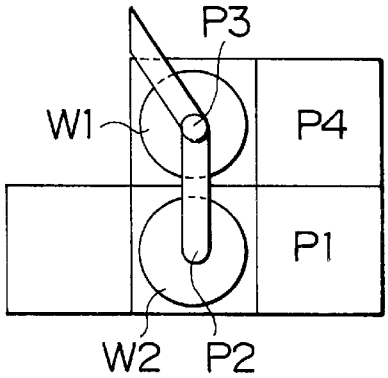

After the cutting of the wafer W1 is completed and the wafer W1 returns to the position P2 as shown in FIG. 4(E), the chuck parts 56, 58 grip the wafers W1, W2. Then, the slide arm 52 moves backward and the rotary arm 54 rotates by 90° clockwise. Thereby, as shown in FIG. 4(F), the wafers W1 and W2 move to the positions P3 and P2, respectively, and the wafers W1 and W2 are placed on the spin table and the cutting table, respectively. If the slide arm 52 and the rotary arm 54 are driven at the same time, the chuck part 58 can substantially move straight from P1 to P2. Thus, the wafer can be transferred in a smaller area than in the case when the conventional rotary arm is used.

Figure 4G:
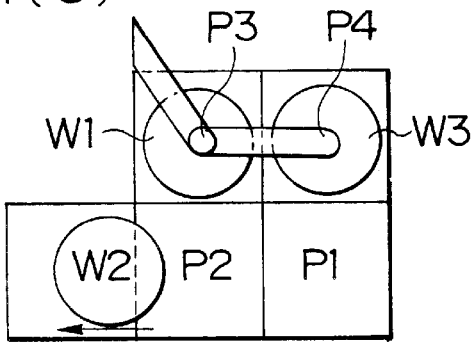

After the wafers W1, W2 are released from the chuck parts 56, 58, the rotary arm 54 rotates by 90° counterclockwise. The wafer W1 is cleansed by the cleansing part 20 at the position P3, and the wafer W2 is cut by the cutting part 10. While the wafer W1 is being cleansed, a next wafer W3 is transferred by the elevator part 40 to the position P4. This is illustrated in FIG. 4(G).

Figure 4J:
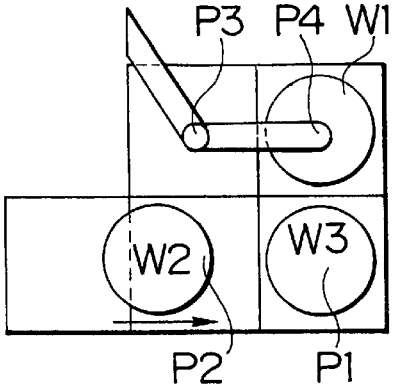
Figure 4H:
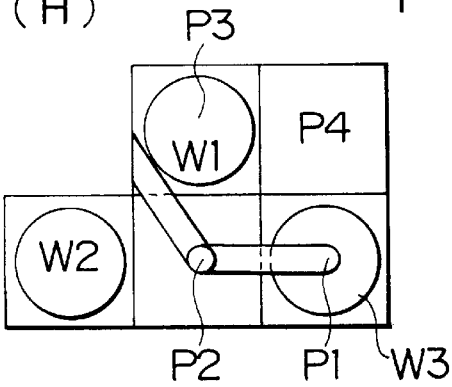
Figure 4K:
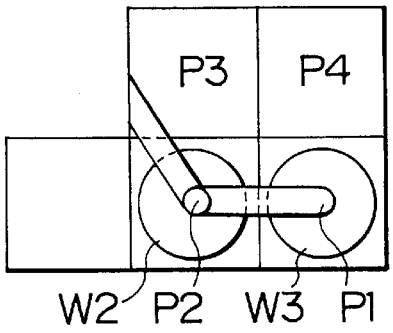
Figure 4I:
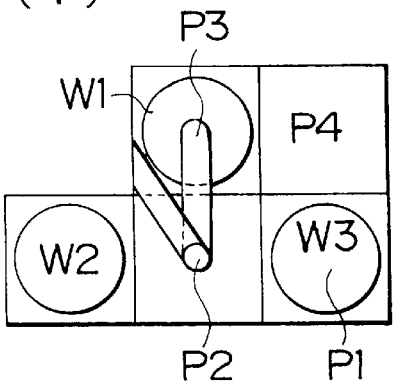

In the above-mentioned state, the chuck part 58 grips the wafer W3, and the slide arm 52 moves forward while the rotary arm 54 is fixed. Thereby, the wafer W3 moves from P4 to P1 as shown in FIG. 4(H), and is placed on the preload stage at P1. After moving the wafer W3 to P1, the rotary arm 54 rotates by 90° counterclockwise as shown in FIG. 4(I).

After the cleansing of the wafer W1 is completed, the chuck part 58 picks up the wafer W1 from the cleansing part 20, and the rotary arm 54 rotates by 90° clockwise and the slide arm 52 moves backward. Thereby, the wafer W1 moves to P4 as shown in FIG. 4(J). The wafer W1 is released from the chuck part 58 at P4 and is placed on the elevator part 40. Then, the wafer W1 is stored at a proper position in the cassette part 30.

After the wafer W1 is placed on the elevator part 40, the slide arm 52 moves forward. FIG. 4(K) illustrates the state after the cutting of the wafer W2 is completed and the wafer W2 returns to the position P2. This state is the same as that shown in FIG. 4(E), and the procedure starting from FIG. 4(E) is repeatedly executed.

Thus, the wafers before cutting are successively removed from the cassette part 30, and after completion of cutting and cleansing, the cut and cleansed wafers are successively stored in the cassette part 30.

According to the above-described transfer unit 50, the wafer is transferred from the position P2, where the wafer is loaded and unloaded on and from the cutting table, to the position P3, where the wafer is loaded and unloaded on and from the spin table, by the chuck part 56 which moves straight only between P2 and P3. The wafer is transferred between the other positions by the chuck part 58 which rotates at a predetermined distance away from the chuck part 56. Thereby, the wafer to which the sludge adheres during the cutting is transferred only by the chuck part 56, and the chuck part 56 moves only between P2 and P3. For this reason, the sludge does not adhere to the cleansed wafer before and after the cutting, and the sludge adhering to the chuck part 56 is not spread.

Moreover, the slide arm 52 is moved and the rotary arm 54 is rotated at the same time, so that the chuck part 58 mounted at the front end 54B of the rotary arm 54 can move straight, and thereby the space required for transferring the wafer can be small.

As set forth hereinabove, according to the workpiece transfer unit in the dicing machine of the present invention, the first arm part is moved from the reference position, where the workpiece is supplied to the workpiece cutting part, to the cleansing position, where the cut workpiece is cleansed, so that the workpiece can be transferred in the first direction. The first arm part is moved in the first direction and the second arm part is rotated so that the workpiece can be transferred in the second direction, which is perpendicular to the first direction. Thus, the first chuck part, which is provided at the front end of the first arm part, moves only between the reference position and the cleansing position, thereby preventing the spread of the sludge adhering to the first chuck part when the cut workpiece is mounted. Moreover, there is no need to provide the transfer arm at the center of each workpiece transfer position, and the workpiece can be transferred straight between the two positions. Hence, compared with the conventional rotary arm, the space can be saved. Furthermore, compared with the conventional rotary arm, a combination of the first and second arms can enlarge the accessible area.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. Workpiece transfer equipment in a dicing machine having a work piece cutting part for cutting a workpiece, a reference position from which the workpiece is transferred to said workpiece cutting part, a cleansing position where the cut workpiece is cleansed, said cleansing position being at a predetermined distance in a first direction from said reference position, and one or two stage positions which are at a predetermined distance from said reference position and/or said cleansing position in a second direction perpendicular to said first direction, said workpiece transfer equipment transferring the workpiece between said positions, said workpiece transfer equipment comprising:

a first arm part for transferring the workpiece from said reference position to said cleansing position with a first chuck part provided at a front end of said first arm part, said first arm part being movable in said first direction, said first chuck part gripping and releasing the workpiece;

a second arm part for transferring the workpiece with a second chuck part provided at a front end of said second arm part, said second arm part being rotatably supported at a base end by said front end of said first arm part, said second chuck part being at a distance equal to said distance between said reference position and said stage position from said first chuck part, said second chuck part gripping and releasing the workpiece;

first arm driving means for moving said first arm part in said first direction;

second arm driving means for rotating said second arm part;

controlling means for controlling said first and second arm driving means and controlling said first and second chuck parts to grip and release the workpiece; and wherein said controlling means moves said first arm part in said first direction so as to transfer the workpiece in said first direction, and moves said first arm part in said first direction and rotates said second arm part so as to transfer the workpiece in said second direction.

2. The workpiece transfer equipment as defined in claim 1, wherein said controlling means moves a workpiece in said first direction and moves another workpiece in said second direction at the same time.

3. The workpiece transfer equipment as defined in claim 1, wherein said controlling means moves said first arm part in said first direction and rotates said second arm part at the same time so as to linearly move said second chuck part.

4. The workpiece transfer equipment as defined in claim 1, wherein said controlling means moves a workpiece in said second direction from said stage to said reference position, moves said workpiece in said first direction from said reference position to said cleansing position, and moves said workpiece in said second direction from said cleansing position to said stage.

5. The workpiece transfer equipment as defined in claim 1, wherein said two stages comprises:

a first stage for loading a workpiece having not been processed and unloading a processed workpiece; and a second stage for preloading a workpiece before moving the workpiece from said first stage to said reference position.

* * * * *